US009377754B2

(12) United States Patent
Kitajima et al.

(10) Patent No.: US 9,377,754 B2
(45) Date of Patent: Jun. 28, 2016

(54) PROCESS CARTRIDGE

(75) Inventors: Kazushi Kitajima, Yokohama (JP); Toshihiko Kudo, Sorachi-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/117,918

(22) PCT Filed: Aug. 3, 2012

(86) PCT No.: PCT/JP2012/070405

§ 371 (c)(1),
(2), (4) Date: Nov. 15, 2013

(87) PCT Pub. No.: WO2013/022078

PCT Pub. Date: Feb. 14, 2013

(65) Prior Publication Data

US 2014/0086630 A1 Mar. 27, 2014

(30) Foreign Application Priority Data

Aug. 5, 2011 (JP) ..... 2011-171994

(51) Int. Cl.
*G03G 21/16* (2006.01)
*G03G 21/18* (2006.01)
*G03G 15/02* (2006.01)

(52) U.S. Cl.
CPC ..... *G03G 21/1839* (2013.01); *G03G 15/0233* (2013.01)

(58) Field of Classification Search
CPC ..... G03G 2221/1884; G03G 21/1839; G03G 21/186; G03G 21/1609; G03G 2221/1657; G03G 2221/1853; G03G 21/1821; G03G 15/0872; G03G 21/185; G03G 15/0812; G03G 21/1814; G03G 21/1825; G03G 15/0225
See application file for complete search history.

(56) References Cited

U.S. PATENT DOCUMENTS

| | | | | |
|---|---|---|---|---|
| 5,134,441 | A | 7/1992 | Nagata et al. | |
| 2007/0248382 | A1 * | 10/2007 | Oguma et al. | 399/167 |
| 2013/0121725 | A1 * | 5/2013 | Shirayanagi | 399/111 |

FOREIGN PATENT DOCUMENTS

| | | | |
|---|---|---|---|
| EP | 0 757 304 | A2 | 2/1997 |
| EP | 1 102 131 | A2 | 5/2001 |
| EP | 1 519 248 | A1 | 3/2005 |
| JP | 2003-076117 | A | 3/2003 |
| JP | 2008-058686 | A | 3/2003 |

OTHER PUBLICATIONS

Office Action in Chinese Patent Application No. 201280038147.9, dated Jul. 2, 2015 (with English translation).

* cited by examiner

*Primary Examiner* — Roy Y Yi
(74) *Attorney, Agent, or Firm* — Fitzpatrick, Cella, Harper & Scinto

(57) ABSTRACT

A process cartridge detachably mountable to a main assembly of an electrophotographic image forming apparatus includes a rotatable photosensitive drum; a charging roller for contacting and electrically charging the drum; a spacer for supporting a rotation shaft of the charging roller to space the drum from the charging roller; and an urging member for contacting the spacer to urge the charging roller toward the drum; wherein the spacer is movable between a first position for spacing the charging roller from the drum and a second position for contacting the charging roller to the drum, and an urging force of the urging member applied to the spacer is smaller when the spacer is in the second position than when the spacer is in the first position.

5 Claims, 9 Drawing Sheets

(a)

(b)

(a)

(b)

(a)

(b)

(c)

PROCESS CARTRIDGE

TECHNICAL FIELD

The present invention relates to a process cartridge which is removably installable in the main assembly of an electrophotographic image forming apparatus.

BACKGROUND ART

There has been an increasing number of an electrophotographic image forming apparatus structured so that a unit (which hereafter will be referred to as process cartridge), which is a cassette in which image formation components are integrally disposed, is removably installable in the main assembly of the apparatus, in order to make it easier to maintain an electrophotographic image forming apparatus.

Many of the process cartridges usable with the abovementioned electrophotographic image forming apparatuses employ a charge roller as a charging member, and are structured to place the charge roller in contact with a photosensitive member to charge the photosensitive member. Further, a substantial number of process cartridges which employ a charge roller are structured so that the charge roller is kept pressed upon the peripheral surface of their photosensitive member with the use of springs or the like in order to keep stable the charge nip between the peripheral surface of the charge roller and that of the photosensitive member.

However, if a charge roller is continuously kept pressed upon a photosensitive member from when a process cartridge is shipped out of a process cartridge factory (when process cartridge is completed) to when the cartridge is used for the first time, the charge roller will become deformed. Obviously, the usage of a deformed charge roller for image formation results in the formation of an unsatisfactory image.

One of the conceivable means for dealing with the above-described problem is to structure a process cartridge so that a spacer is placed between its charge roller and photosensitive member. It has been common practice to structure a process cartridge so that before the process cartridge is installed in the main assembly of an image forming apparatus by a user, the spacer is removed by the user to place the charge roller in contact with the photosensitive drum. However, from the standpoint of usability, it is desired that a process cartridge is structured so that as the process cartridge is installed into the main assembly of an image forming apparatus, its spacer which has kept the charge roller separated from the photosensitive drum is retracted by the force which the spacer receives from the main assembly of the apparatus.

For example, Japanese Laid-open Patent Application 2003-76117 discloses a process cartridge which has a spacer for keeping a charge roller separated from a photosensitive drum, and which is structured so that in order to allow the photosensitive member and charge roller to be placed in contact with each other, the spacer is rotationally movable about the shaft of the charge roller by the force which the spacer receives from the main assembly of the image forming apparatus.

It is desired that a charge roller is kept pressed upon a photosensitive drum to keep the charge nip stable during an image forming operation. This is true for a process cartridge structured so that its charge roller and photosensitive member are kept separated from each other by its spacer until it is installed in the main assembly of an image forming apparatus for the first time. For example, in the case of the process cartridge disclosed in the aforementioned Japanese Laid-open Patent Application 2003-76117, the cartridge is structured so that the bearings for the shaft of the charge roller, which are independent from the spacer, are kept pressed toward the photosensitive drum with the use of springs in order to keep the charge nip stable.

However, placing the bearing which bears the force for keeping the charge roller pressed toward the photosensitive member while bearing the shaft of the charge roller as disclosed in Japanese Laid-open Patent Application 2003-76117, and the spacer, side by side in terms of the lengthwise direction of the charge roller requires a process cartridge to be increased in length.

One of the conceivable solutions to the above described problem is to integrate the bearing which bears the force for keeping the charge roller pressed toward the photosensitive member while bearing the shaft of the charge roller, with the spacer.

However, in the case of a process cartridge structured so that its spacer which is rotationally movable about the shaft of the charge roller is given the force for allowing the charge roller to be placed in contact with the photosensitive drum of the cartridge and keeping the charge roller in contact with the photosensitive drum thereafter, it was difficult to keep stable the force for keeping the charge roller in contact with the photosensitive member after the rotational movement of the spacer. That is, the above described structural arrangement for a process cartridge is problematic in that the pressure applying members for applying pressure to the spacers after the rotational movement of the spacer about the shaft of the charge roller, which is caused by the force from the main assembly of the image forming apparatus, is made to be unstable in attitude by the rotation of the spacer.

DISCLOSURE OF THE INVENTION

Thus, the primary object of the present invention is to provide a process cartridge which keeps its charge roller and photosensitive member separated from each other until the cartridge receives the cartridge driving force from the main assembly of an image forming apparatus, is no greater in length than any process cartridge in accordance with the prior art, and is stable in the amount of force for keeping the charge roller in contact with the photosensitive member.

According to an aspect of the present invention, there is provided a process cartridge comprising a rotatable photosensitive member; a charging roller for contacting and electrically charging said photosensitive member; a spacer for supporting a rotation shaft of the charging roller to space said photosensitive member from said charging roller; and an urging member for contacting said spacer to urge said charging roller toward said photosensitive member; wherein said spacer is movable between a first position for spacing said charging roller from said photosensitive member and a second position for contacting said charging roller to said photosensitive member, and an urging force of said urging member applied to said spacer is smaller when said spacer is in the second position than when said spacer is in the first position.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Embodiment 1

Hereinafter, the main assembly of the electrophotographic image forming apparatus in this embodiment, in which the process cartridge in this embodiment is installed, is briefly described. Then, the structure of the process cartridge is described in detail.

1. {General Structure of Image Forming Apparatus}

Figure 1:
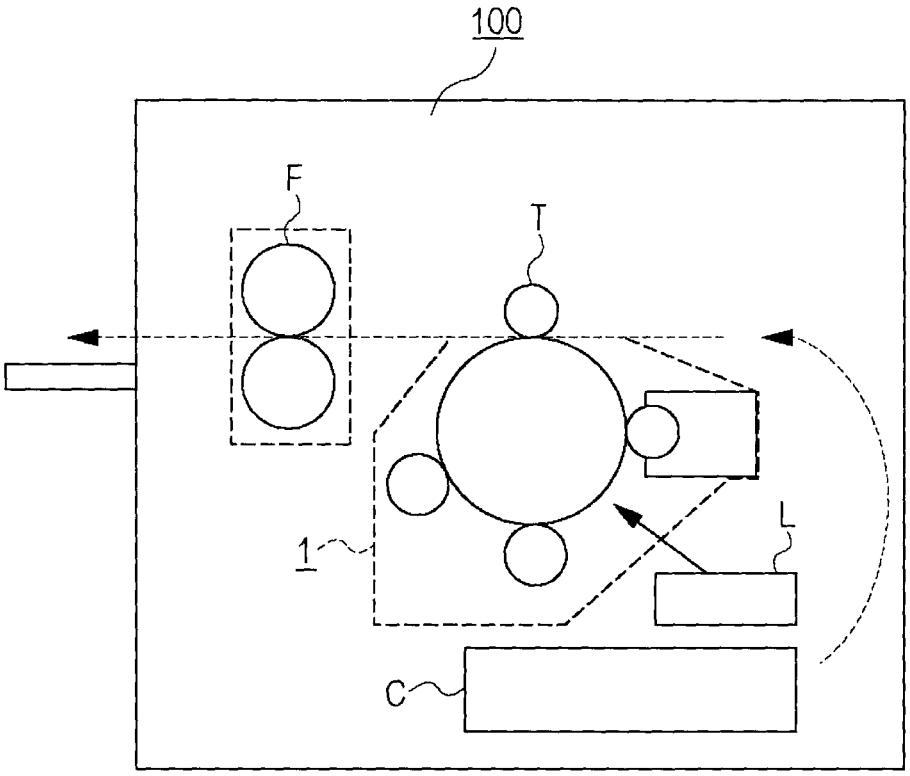
FIG. 1 is a schematic sectional view of the main assembly of the image forming apparatus in the first embodiment of the present invention, and shows the general structure of the apparatus.

FIG. 1 is a drawing for describing the general structure of the image forming apparatus in this embodiment. The image forming apparatus 100 is structured so that a process cartridge 1 having a minimum of a cylindrical photosensitive drum 7 as a rotatable photosensitive member, and a charge roller which charges the peripheral surface of the photosensitive drum 7 by being placed in contact with the peripheral surface is installable. The process cartridge 1 is provided with electrical contacts through which the cartridge 1 receives electric power from the main assembly of the image forming apparatus, and a coupling through which the cartridge 1 receives mechanical power from the main assembly of the image forming apparatus (which hereafter may be referred to simply as apparatus main assembly).

The image forming apparatus 100 transfers a toner image formed on the peripheral surface of the photosensitive member in the process cartridge 1, onto a sheet of recording medium delivered from a cassette C, with use of its transfer roller T. After the transfer of the toner image onto the sheet of recording medium, the toner image on the sheet of recording medium is thermally fixed to the surface of the sheet by a fixing device F. Then, the sheet is discharged as a finished print from the apparatus main assembly.

2. {General Structure of Process Cartridge}

Next, the process cartridge 1 which is removably installable in the apparatus main assembly is described in detail.

(General Structure of Image Formation Unit)

Figure 2:
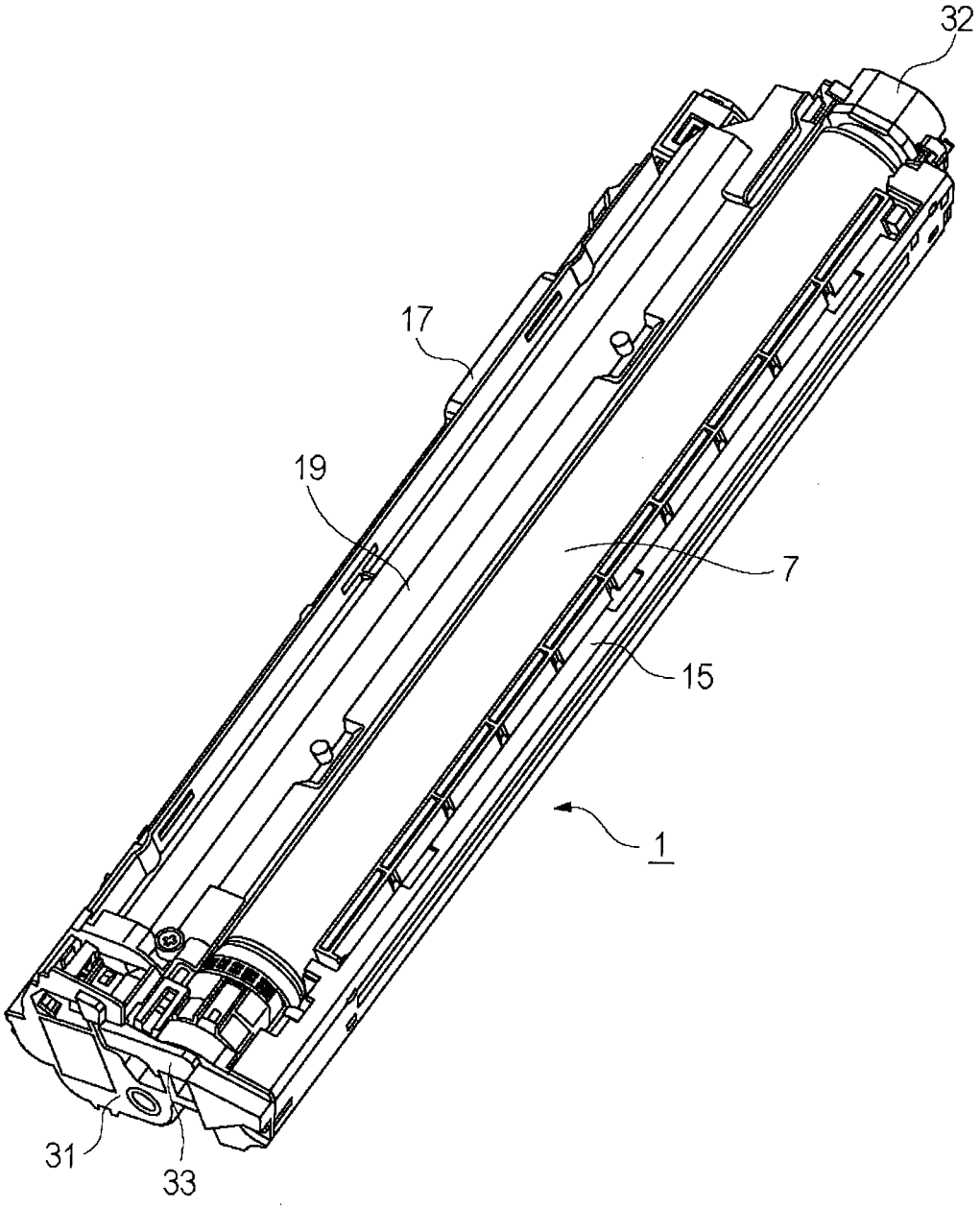
FIG. 2 is a perspective view of the process cartridge in the first embodiment.
Figure 3:
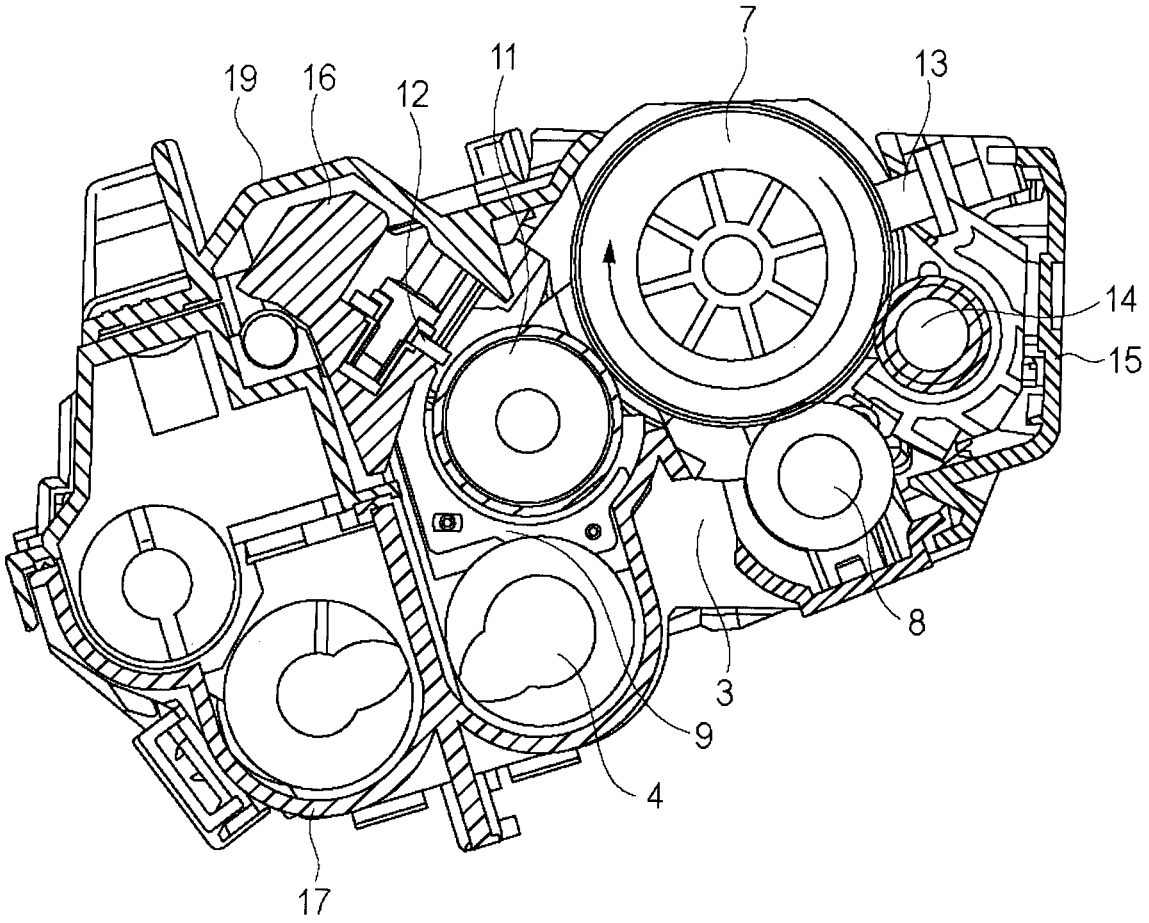
FIG. 3 is a schematic sectional view of the process cartridge in the first embodiment, at a plane parallel to the lengthwise direction of the cartridge.

The process cartridge 1 as the image formation unit in this embodiment employs a cleanerless cleaning system for recovering the transfer residual toner, that is, the toner which failed to be transferred onto a sheet of recording medium, and therefore, is remaining on the peripheral surface of the photosensitive member after the image transfer; it recovers the transfer residual toner by adjusting the transfer residual toner in electrical charge. Needless to say, the process cartridge 1 may be provided with a cleaning blade as a member for removing the transfer residual toner on the peripheral surface of the photosensitive member. FIG. 2 is a perspective view of the process cartridge in this embodiment. FIG. 3 is a sectional view of the process cartridge 1 in this embodiment, at a plane perpendicular to the lengthwise direction of the cartridge 1.

The process cartridge 1 is provided with the charge roller 8 as a charging member, in addition to the photosensitive drum 7 which is rotatable. The charge roller 8 is rotated by the rotation of the photosensitive drum 8. As charge bias is applied to the charge roller 8, the charge roller 8 charges the photosensitive drum 7. The peripheral surface of the photosensitive drum 7 charged by the charging member is exposed by a laser scanner 1 with which the apparatus main assembly is provided. Consequently, an electrostatic latent image is effected on the peripheral surface of the photosensitive drum 7.

The developing device in this embodiment is provided with a screw 4 as a developer conveying rotatable member, which stirs the toner in the toner storage chamber 9 as it conveys the toner. Further, the developing device is provided with a development sleeve 11 as a rotatable member for developing the electrostatic latent image on the peripheral surface of the photosensitive drum 7. The development sleeve 11 holds a stationary magnet in its hollow. The toner in the toner storage chamber 9 is borne by the development sleeve 11 and is conveyed to the development area by the development sleeve 11 while being stirred. Further, the developing device is provided with a development blade 12 which regulates in thickness the toner layer on the peripheral surface of the development sleeve 11 while the toner layer is conveyed to the development area. As the toner is conveyed to the development area, it develops the electrostatic latent image on the peripheral surface of the photosensitive drum 7 into a visible image, that is, an image formed of toner, by being transferred onto the peripheral surface of the photosensitive drum 7 by the development bias applied to the development sleeve 11. Then, the toner image on the photosensitive member is transferred onto a sheet of recording medium (paper, or the like) as a medium onto which a toner image is transferable, by the voltage applied to the transfer roller T. The voltage applied to the transfer roller T is opposite in polarity to the polarity of the toner particles of which the toner image is formed.

The process cartridge 1 in this embodiment employs a cleaner-less system. That is, after the transfer of the toner image onto a sheet of recording medium from the peripheral surface of the photosensitive member, the toner which failed to be transferred onto a sheet of recording medium, and therefore, is remaining on the peripheral surface of the photosensitive member after the transfer, is adjusted in electric charge by a pair of auxiliary charging members positioned downstream of the transfer station, so that it will be recovered into the developing device. Each of the auxiliary charging members in this embodiment is a brush roller, and is rotated by the force which it receives from the apparatus main assembly.

Next, the frame (shell) of the process cartridge in this embodiment is briefly described. The frame of the process cartridge 1 in this embodiment is made up of multiple sub-frames, that is, a charging means sub-frame 15, a developing means sub-frame 16, and a toner storage sub-frame 17. The charging means sub-frame 15 holds: a deck brush 13, or the upstream brush, which contacts the peripheral surface of the photosensitive drum 7; a brush roller 14, or the downstream brush, which contacts the peripheral surface of the photosensitive drum 7; and charge roller 8. The developing means sub-frame 16 supports a developing means, that is, a combination of a development blade 12 and a development sleeve 11. The toner storage sub-frame 17 has a toner storage 9 and holds the photosensitive drum 7. Further, the process cartridge 1 in this embodiment has: a pair of lateral covers 31 which cover the lengthwise ends of the cartridge, one for one; a pair of drum supporting members 32 which support the photosensitive drum 7; a handhold for taking the process cartridge 1 out of the apparatus main assembly; and a top cover 19 which covers the top side of the toner storage sub-frame 17.

Given above are the brief descriptions of the structural features of the process cartridge 1.

(Structure of Charge Roller)

Next, the charge roller 8 used in this embodiment is described in detail. The charge roller 8 in this embodiment is made up of a metallic core which is 8 mm in diameter, and an elastic layer which covers the peripheral surface of the metallic core. The elastic layer is made of a mixture of ethylene-propylene rubber, nitrile rubber, epichlorohydrine rubber, or the like, and additives for controlling the elastic layer in the amount of electrical resistance. The overall diameter of charge roller 8 is 14 mm. In terms of the lengthwise direction of the charge roller 8, the dimension of the area of contact between the peripheral surface of the charge roller 8 and photosensitive drum 7 is 312 mm. The amount of pressure by which the charge roller 3 needs to be pressed upon the photosensitive drum 7 to ensure that the peripheral surface of the photosensitive drum 7 is uniformly charged is 7.7 N.

Thus, if the charge roller 8 is kept pressed upon the photosensitive drum 7 with the application of 7.7 N of pressure for a long period of time (process cartridge is one of expendable office supplies, and therefore, it is possible for process cartridge to be stored longer than one year), the elastic layer is deformed across the aforementioned area of contact between the charge roller 8 and photosensitive drum 7. Obviously, using a deformed charge roller to charge the photosensitive member will result in the nonuniform charging of the photosensitive member, which in turn results in the formation of an unsatisfactory image. Therefore, it is desired that the photosensitive drum 7 and charge roller 8 are kept separated from each other until the process cartridge 1 is installed in the apparatus main assembly for the first time to be used for image formation.

3. {Charge Roller Separation Mechanism}

Described next is the mechanism which changes the state of the process cartridge 1 from the state in which the charge roller 8 and photosensitive drum 7 are kept separated from each other, to the state in which the charge roller 8 and photosensitive drum 7 are kept in contact with each other, as the process cartridge 1 receives driving force from the apparatus main assembly after the installation of the cartridge 1 into the main assembly.

Next, the spacer 21 which functions not only as a member for keeping the charge roller 8 separated from the photosensitive drum 7 for the length of time between when the process cartridge 1 is shipped out of its factory (when cartridge 1 was manufactured) and when the cartridge 1 is used for the first time for image formation, but also as a bearing for supporting the charge roller 8 by the shaft of the charge roller 8, with the presence a play between itself and the shaft, is described regarding its shape. Then, the relationship between the spacer 21 and a member which keeps the spacer pressured toward the photosensitive drum 7 is described.

(Shape of Spacer)

Figure 4:
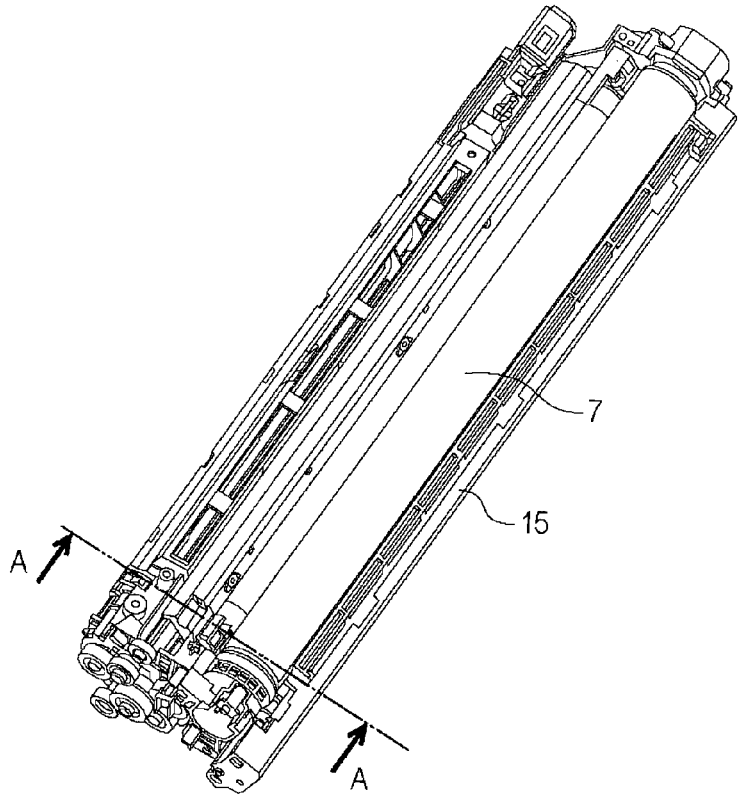
FIG. 4 is a drawing for describing the positioning of the spacer in the first embodiment.
Figure 4:
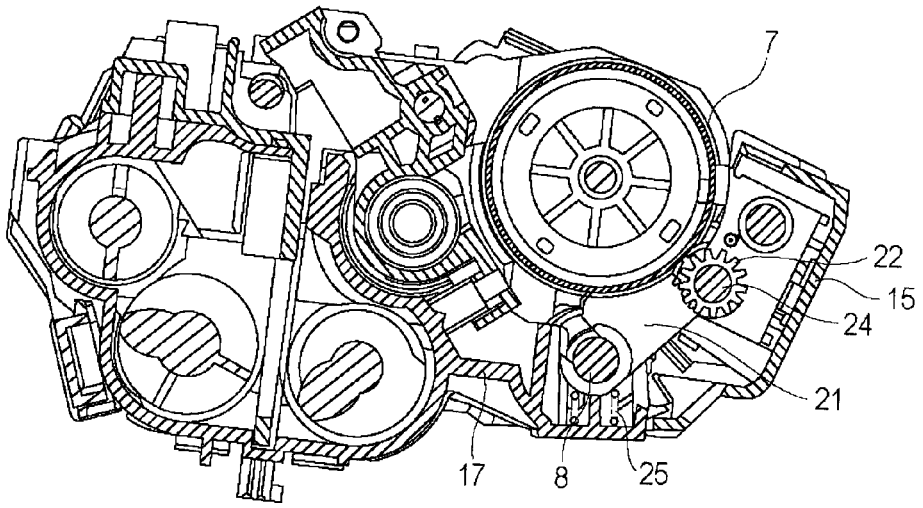
Figure 5:
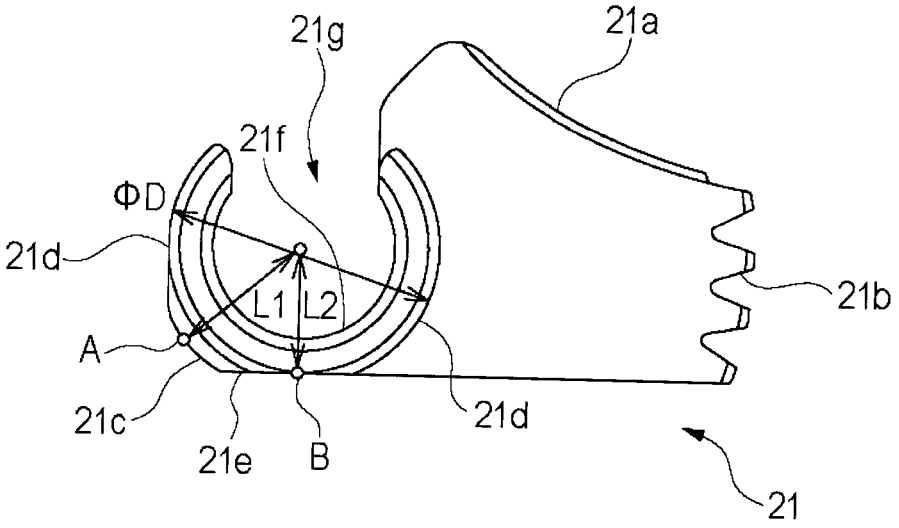
FIG. 5 is a drawing for describing the shape of the spacer in the first embodiment.
Figure 5:
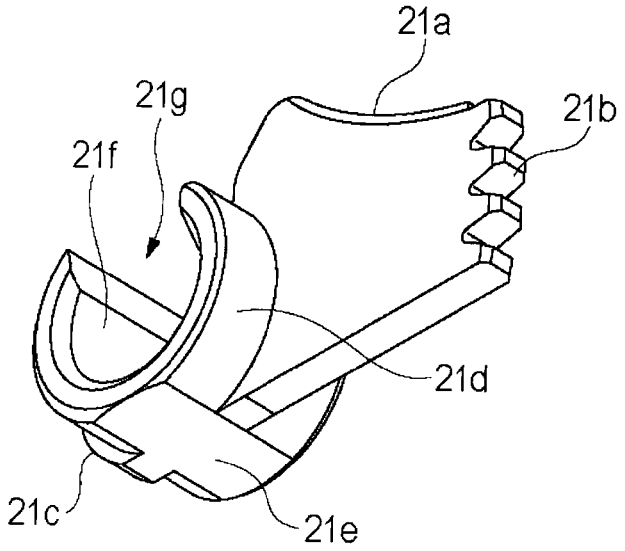

FIG. 4(*a*) is a perspective view of the process cartridge 1 minus the top cover 19, when the spacer 21 is in contact with the photosensitive drum 7. FIG. 4(*b*) is a sectional view of the process cartridge 1 shown in FIG. 4(*a*), at a plane perpendicular to the lengthwise direction of the cartridge 1, when the photosensitive drum 7 and charge roller 8 are remaining separated from each other. FIG. 5(*a*) is a side view of the spacer 21, and FIG. 5(*b*) is a perspective view of the spacer 21. Referring to FIG. 4(*a*), during the period between when the process cartridge 1 is shipped out of its factory, and when the process cartridge is used for the first time, the spacer 21 is kept in contact with the peripheral surface of the photosensitive drum 7, and keeps supporting the shaft of the charge roller 8, with the presence of a preset amount of play between itself and the shaft of the charge roller 8. Then, the shape of this spacer 21 is described regarding the five sections of the spacer 21, which is related to the present invention.

A: Recessively Arced Section

One of various surfaces of the spacer 21, which comes into contact with the peripheral surface of the photosensitive drum 7 is recessively arced; it is given such a curvature that can accommodate the curvature of the peripheral surface of the photosensitive drum 7. More specifically, this surface which is placed in contact with the peripheral surface of the photosensitive drum 7 to keep the charge roller 8 separated from the photosensitive drum 7 is greater in radius of curvature than the photosensitive drum 7, ensuring thereby that even if the process cartridge 1 is subjected to a substantial amount of vibration, the point of contact between the charge roller 8 and photosensitive drum 7 shifts back into a preset position (in which point of contact remains when cartridge is stationary). More concretely, in order to make the spacer 21 smoothly contact the peripheral surface of the photosensitive drum 7, the spacer 21 is shaped so that the surface 21*a* of the spacer 21, which is recessively arced, becomes half the photosensitive drum 7 in the radius of curvature.

B: Bearing Section (Shaft Supporting Section)

The spacer 21 has a section (inward surface 21*f*) by which it supports the rotational shaft of the charge roller 8. For the ease of assembly, the supporting section is U-shaped in cross section. Further, the spacer 21 is shaped so that when the spacer 21 is in the position in which it functions as a bearing, the opening 21*g* faces the photosensitive drum 7.

Obviously, the relationship between the external diameter of the rotational shaft of the charge roller 8 and the internal diameter of the bearing section of the spacer 21 is such that when the rotational shaft of the charge roller 8 is fitted into the bearing section, there is a certain amount of play between the shaft and bearing section (inward surface 21*f*). More concretely, the rotational shaft of the charge roller 8 is 8 mm in diameter, whereas the bearing section is 8.1+0.1 mm in internal diameter.

C: Gear Section

As the spacer 21 receives driving force from the apparatus main assembly when it is in the position in which it keeps the charge roller 8 separated from the photosensitive drum 7, it moves into the position in which it allows the charge roller 8 to come into contact with the photosensitive drum 7. As for the structural arrangement to allow this movement of the spacer 21, the spacer 21 is provided with a gear section, which meshes with a gear 24 which rotates by receiving driving force from the apparatus main assembly. More concretely, the gear section of the spacer 21 meshes with the gear 24. The gear section of the spacer 21 is in the form of a sector gear, and the spacer 21 is shaped so that as the charge roller 8 comes into contact with the photosensitive drum 7, the gear section of the spacer 21 disengages from the gear 24.

Figure 7:
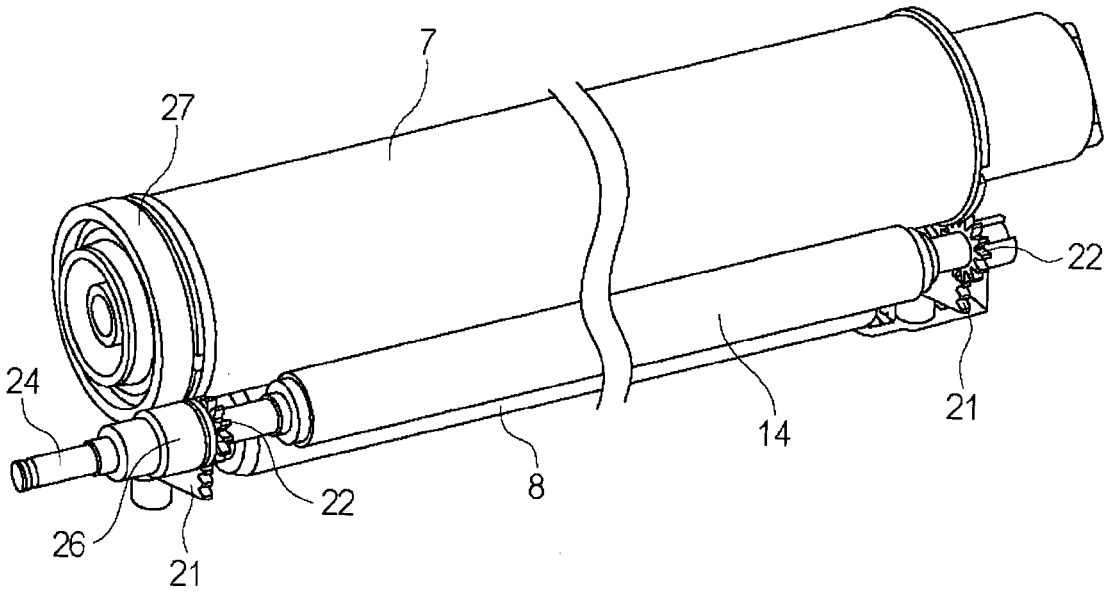
FIG. 7 is a perspective view of the combination of the photosensitive drum, charge roller, spacers, etc., in the first embodiment, and is for describing the transmission of the driving force to the spacer.

FIG. 7 is a drawing for describing the transmission of driving force, which occurs as the spacer 21 in this embodiment rotates. The process cartridge 1 is provided with a pair of spacers 21, which are located at the lengthwise ends of the charge roller 8, one for one. Each spacer 21 is provided with a gear section which meshes with a gear 22 attached to the rotational shaft 24 of the brush roller 14 as the auxiliary charging member. The brush roller 14, which is on the downstream side of the photosensitive drum 7, is provided with a gear 26 attached to the rotational shaft 24 of the brush roller 14. Further, the gear 26 is in mesh with a drum flange gear 27 attached to one of the lengthwise ends of the photosensitive drum 7, and rotates by receiving driving force from the apparatus main assembly.

D: Protrusively Arced Section which is in Contact with Spring while Charge Roller Remains Separated from Photosensitive Drum In this embodiment, the spacer 21 is provided with the function of the bearing which bears the force that keeps the charge roller 8 (supported by its rotational shaft) pressured toward the photosensitive drum 7, in addition to the function of the member which keeps the charge roller 8 separated from the photosensitive drum 7. Thus, while the spacer 21 is keeping the charge roller 8 separated from the photosensitive drum 7, it is in contact with a spring. Further, the spring remains in contact with the spacer 21 even while the spacer 21 is rotationally moved from the position in which the spacer 21 keeps the charge roller 8 separated from the photosensitive drum 7 to the position in which the spacer 21 allows the charge roller 8 to be in contact with the photosensitive drum 7.

The spacer 21 is shaped so that the section of the spacer 21 in this embodiment, which is in contact with the spring while the spacer 21 keeps the charge roller 8 separated from the photosensitive drum 7, protrusively arcs. More concretely, referring to FIG. 5(*a*), the spacer 21 is shaped so that when the spacer 21 is in the position in which it keeps the charge roller 8 separated from the photosensitive drum 7, a distance L1 between the rotational axis of the charge roller 8 to the point A of contact between the spring and the protrusively arced section of the spacer 21 is 9.4 mm.

E: Flat Section which is in Contact with Spring when Charge Roller is in Contact with Photosensitive Drum 7

In this embodiment, the pressure applied to the shaft of the charge roller 8 to stabilize the charge nip when the charge roller 8 is in contact with the photosensitive drum 7 is borne by the spacer 21. Thus, the spacer 21 in this embodiment is provided with a flat section, which remains in contact with the pressure applying member when the charge roller 8 is in contact with the photosensitive drum 7.

Unlike the above-described section with the outward curvature, the flat section contributes to the stability of the charge nip formed between the charge roller 8 and photosensitive drum 7 when the charge roller 8 is in contact with the photosensitive drum 7. More concretely, referring to FIG. 5(*a*), the spacer 21 is shaped so that when the charge roller 8 is in contact with the photosensitive drum 7, a distance L2 from the rotational axis of the charge roller 8 to a point B of contact between the flat section of the spacer 21 and the spring is 7 mm. Further, the spacer 21 is shaped so that when the charge roller 8 is in contact with the photosensitive drum 7, the spring supporting surface of the cartridge 1 is roughly parallel to the flat surface of the spacer 21.

(Pressure Applying Member which Applies Pressure to Spacer)

The spacer 21 in this embodiment, which functions as the bearing for the charge roller shaft, doubles as the very spacer that separates the charge roller 8, and keeps the charge roller 8 separated from the photosensitive drum 7. When the charge roller 8 is remaining separated from the photosensitive drum 7, the spring, as the pressure applying member, is in contact with the flat surface 21*e* of the spacer 21, and therefore, the pressure from the pressure applying member pressures the charge roller 8 upon the photosensitive drum 7 through the spacer 21. Here, while the spacer 21 is moved from the position in which it keeps the charge roller 8 separated from the photosensitive drum 7 to the position in which it allows the charge roller 8 to be in contact with the photosensitive drum 7, the spring keeps on pressuring the spacer 21 toward the photosensitive drum 7. Next, the pressure generated by the spring when the charge roller 8 is kept separated from the photosensitive drum 7 by the spacer 21, and that when the charge roller 8 is allowed by the spacer 21 to be in contact with the photosensitive drum 7, are described. Incidentally, the pressure applying member in this embodiment is a spring, but, the pressure applying member may be such an elastic member that is made of rubber or the like.

A: Amount of Pressure Generated by Spring when Charge Roller is Kept Separated from Photosensitive Drum 7 by Spacer In the case of the process cartridge 1 in this embodiment, the amount of pressure necessary to keep the charge roller 8 pressed upon the photosensitive drum 7 to uniformly charge the peripheral surface of the photosensitive drum 7 is 7.7 N. That is, in consideration of the amount of force generated, per lengthwise end of the charge roller 8, by the weight of the combination of the spacer 21, charge roller 8, and each of the components attached to the charge roller 8, the amount of force to be applied to the charge roller 8 by each of the two springs 25 is desired to be 4.75 N. Thus, in this embodiment, a coil spring made of spring steel is used. It is 0.45 mm in wire diameter, 3.5 mm in internal diameter, 10.4 mm in length, and 5.5 in number of active coils. Further, the spring 25 is a coil with closed ends; the lengthwise ends have been processed to be flat.

While the spacer 21 is moved from the position in which it keeps the charge roller 8 separated from the photosensitive drum 7 to the position in which it allows the charge roller 8 to be kept in contact with the photosensitive drum 7, one of the lengthwise ends of the spring 25 remains in contact with the spacer 21. More concretely, referring to FIG. 5, one of the lengthwise ends of the spring 25 remains in contact with the protrusively arced surface section 21*c* of the spacer 21, and also, the flat surface section 21*e* of the spacer 21, which is in connection to the protrusively arced surface section 21*c*. The amount of pressure applied to the spacer 21 by the spring 25 when the charge roller 8 is kept separated from the photosensitive drum 7 is greater than that when the charge roller 8 is in contact with the photosensitive drum 7. As the spring 25, which is La in length when it is not compressed at all, is compressed to a length of roughly 4 mm, the amount of the pressure applied to the spacer 21 by the spring 25 becomes 14.2 N. That is, the amount (14.2 N) of the pressure applied to the spacer 21 by the spring 25 is larger (roughly eight times) than the amount of the force generated by the weight of the combination of the charge roller 8 and the pair of spacers 21. Therefore, the spacer 25 remains stable in attitude even if it is subjected to a substantial amount of impact. By firmly holding the spring 25 as described above, it is possible to prevent the spacer 21 from being easily moved from the position in which the spacer 21 keeps the charge roller 8 separated from the photosensitive drum 7 to the position in which the spacer 21 allows the charge roller 8 to be kept in contact with the photosensitive drum 7, by the vibrations or the like which occur to the process cartridge 1 while the process cartridge 1 is transported.

B: Amount of Pressure Generated by Spring when Charge Roller is in Contact with Photosensitive Drum As described above, the amount of the force necessary to keep the charge roller 8 pressed upon the peripheral surface of the photosensitive drum 7 in order to uniformly charge the peripheral surface of the photosensitive drum 7 8 in this embodiment is 7.7 N. Further, the spacer 21 is shaped so that when it is in the position in which it allows the charge roller 8 to be kept in contact with the photosensitive drum 7 (FIG. 8(*d*)), the length Ld of the spring 25 is 6.4 mm. By shaping the spacer 21 so that the length of the spring 25 when the charge roller 8 is kept in contact with the photosensitive drum 7 is greater than that when the charge roller 8 is kept separated from the photosensitive drum 7, the amount of the force which the spring 25 generates can be reduced by rotationally moving the spacer 21 out of the position in which the spacer 21 keeps the charge roller 8 separated from the photosensitive drum 7.

As the spacer 21 is rotationally moved out of the position in which it keeps the charge roller 8 separated from the photosensitive drum 7, the spring 25 is allowed to be lengthened by its resiliency while being reduced in the amount of force it is generating, reducing thereby the amount of pressure between itself and the spacer 21. Therefore, the effect of the rotation of the spacer 25 upon the attitude of the spring 25 is minimized. That is, it is possible to prevent the problem that as the spacer 21 is rotationally moved, the spring 25 is dragged by the spacer 21. Therefore it is possible to prevent the spring 25 from being tilted and/or displaced by the rotation of the spacer 25. In other words, it is possible to minimize the nonuniformity among process cartridges in terms of the attitude (tilted, upright, etc.) of the spring 25.

C: Shape of Spacer Surface which is in Contact with Spring

The size of the area of contact between the spring 25 and spacer 21 when the charge roller 8 is kept separated from the photosensitive drum 7 by the spacer 21 is smaller than that when the charge roller 8 is allowed by the spacer 21 to be in contact with the photosensitive drum 7. As the spacer 21 is rotationally moved, friction occurs between its protrusively arced portion and the spring 25. This friction has some effect upon the attitude of the spring 25. Thus, by making the friction between the protrusively arced section of the spacer 21 and the spring 25 smaller than the friction between the flat section of the spacer 21 and the spring 25, it is possible to prevent the spring 25 from being changed in attitude by the rotation of the spacer 21. More concretely, the protrusively arced section of the spacer 21 is desired to be less in surface roughness than the flat section of the spacer 21; the former is desired to be made smoother than the latter.

(Installation of Springs and Spacers into Cartridge)

Figure 6:
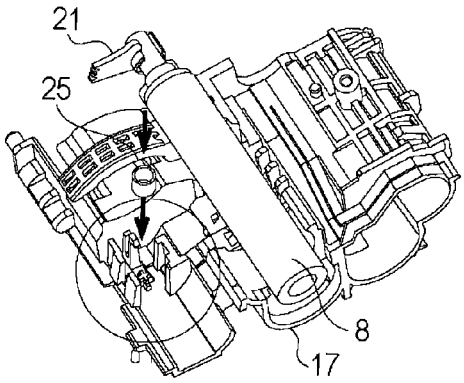
FIG. 6 is a drawing for describing the relationship among the frame, spacer, and spring in the first embodiment.
Figure 6:
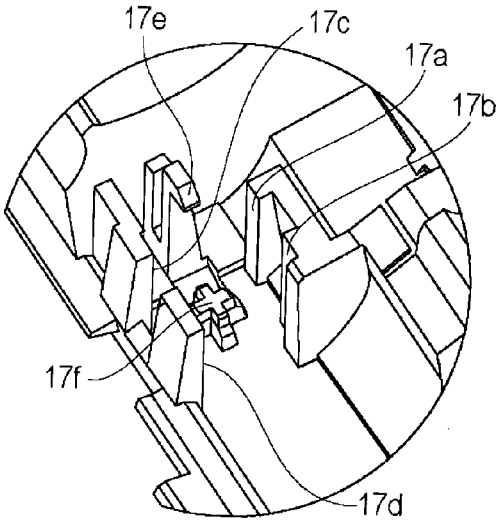
Figure 6:
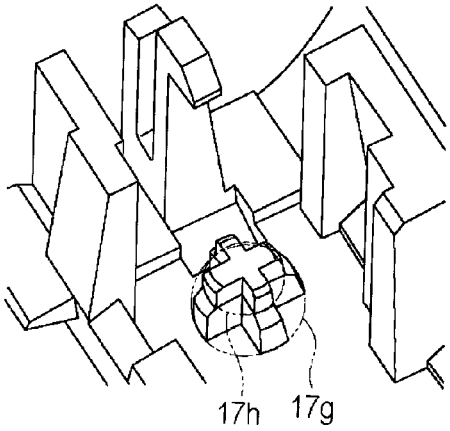

Next, referring to FIG. 6, the method for installing the spacer 21 and spring 25 into the cartridge frame 17 is described.

FIG. 6(*a*) is a drawing for describing the sequence in which the charge roller 8, spacers 21, and springs 25 are attached to the cartridge frame 17. FIGS. 6(*b*) and 6(*c*) are detailed drawings of the portion of the cartridge frame 17, into which the spacer 21 is attached (fitted).

Referring to FIG. 6, designated by referential codes 17*a*-17*d* are the portions of the cartridge frame 17, which play the role of guiding the spacer 21 by the edges of the spacer 21. Designated by a referential code 17*e* is a hook which catches the shaft of the charge roller 8 to prevent the charge roller 8 from being pushed out by the spring 25 during the assembly of the process cartridge 1. Designated by a referential code 17*f* is made up of a portion 17*h* with which the spring 25 engages, and a guide portion 17*g* which retains the spring 25.

The diameter of the guide portion 17*g* is made slightly smaller (3 mm in this embodiment) than the internal diameter (3.5 mm) of the spring 25, and the height of the guide portion 17*g* from the inward surface of the cartridge frame 17 is made to be less (3 mm in this embodiment) by 1-2 mm than the length of the spring 25 when the spring 25 is in the compressed state. With this setup, one of the lengthwise ends of the spring 25 (lengthwise end which is adjacent to cartridge frame) is held by the guide portion 17*g*. Thus, even when the other end of the spring 25 is rubbed by the spacer 21, the spring 25 is kept in such an attitude that its axial line intersects with the axial line of the photosensitive drum 7. Incidentally, both lengthwise ends of the process cartridge 1 are provided with the abovementioned components, portions thereof, etc., although these components, portions thereof, etc., are symmetrically positioned relative to the lengthwise center of the process cartridge 1.

4. {Operation for Moving Spacer from Position in which Spacer Keeps Charge Roller Separated from Photosensitive Drum to Position in which Spacer Allows Charge Roller to be in Contact with Photosensitive Drum}

Figure 8:
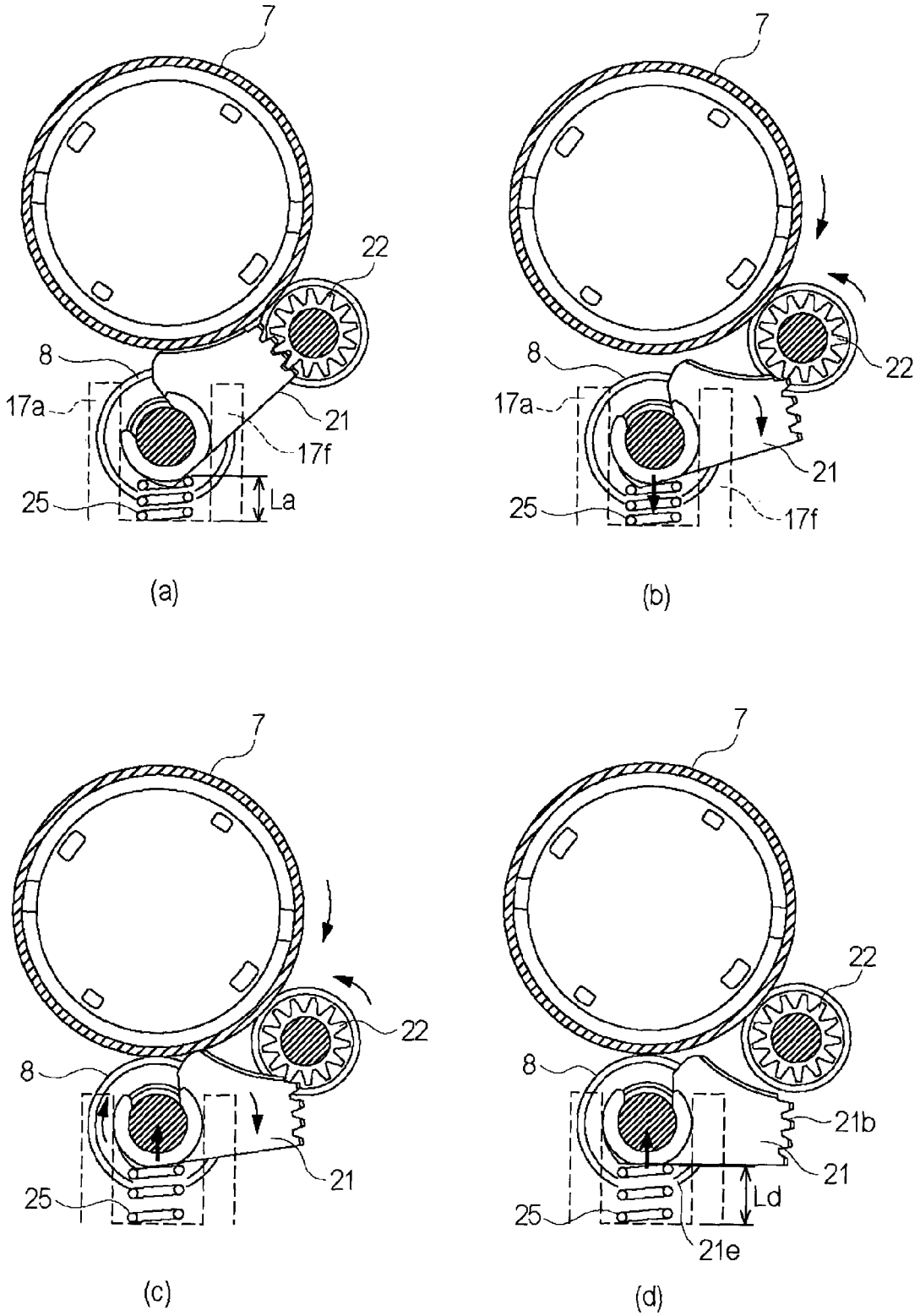
FIG. 8 is a drawing for describing the rotational movement of the spacer in the first embodiment.

Next, referring to FIG. 8, the movement of the spacer 21, which occurs as the spacer 21 receives driving force from the apparatus main assembly, is described. Then, referring to FIG. 9, the relationship between the attitude of the spacer 21 and the attitude of the spring 25 as a pressure applying member, is described.

(Operation for Moving Spacer from Position in which Spacer Keeps Charge Roller Separated from Photosensitive Drum to Position in which Spacer Allows Charge Roller to be in Contact with Photosensitive Drum)

FIGS. 8(*a*)-8(*d*) are drawings for sequentially describing the movements of the spacer 21. FIG. 8(*a*) is a drawing which shows the positional relationship among the photosensitive drum 7, charge roller 8, spacer 21, and gear 22 immediately after the installation of the spacer 21 into the process cartridge 1; the charge roller 3 is kept separated from the photosensitive drum 7 by the spacer 21. When the cartridge 1 is in the state shown in FIG. 8(*a*), the spacer 21 is kept pressed upon the photosensitive drum 7 and gear 22 by the pressure from the spring 25, and therefore, the charge roller 8 is reliably kept separated from the photosensitive drum 7.

Also when the cartridge 1 is in the state shown in FIG. 8(*a*), the spring 25, the length La of which is 10.4 mm, is in the compressed state (compressed to roughly 4 mm), and therefore, the amount of pressure the spring 25 generates when it is in the state shown in FIG. 8(*a*) is 14.4 N as described previously. That is, the amount (14.2 N) of the pressure applied to the spacer 21 by the spring 25 is greater (roughly eight times) than the amount of force (1.8 N) generated by the weight of the combination of the charge roller 8 and the two spacers 21. Therefore, the spacer 21 is kept stable in attitude by the spring 25 even if the process cartridge 1 is subjected to a substantial amount of impact.

Next, referring to FIG. 8(*b*), as the photosensitive drum 7 receives driving force from the apparatus main assembly, it begins to rotate in the direction indicated by an arrow mark. Here, the drum flange gear 27 is in mesh with the gear 26 fitted around the shaft 24 of the brush roller 14 as shown in FIG. 7. Therefore, the gear which is on the same shaft as the shaft on which the gear 26 is, rotates also in the direction indicated by the arrow mark, causing thereby the spacer 24 to rotationally move. Since the process cartridge 1 is structured so that the spacer 21 is guided by the spacer guiding portions 17*a* and 17*b* of the cartridge frame 17, the spacer 21 is rotationally moved by the teeth of the gear 22, while compressing the spring 25 in the direction indicated by an arrow mark, until the toothed section of the spacer 21 disengages from the gear 22.

Next, referring to FIG. 8(*c*), as the toothed section of the spacer 21 disengages from the gear 22, it stops being pushed by the gear 22. Thus, the spacer 21 is moved in the direction indicated by an arrow mark, by the pressure applied to the spacer 21 from the spring 25, and comes into contact with the peripheral surface of the photosensitive drum 7.

Lastly, referring to FIG. 8(*d*), the spacer 21 is rotationally moved until its flat surface 21*e* becomes level with the corresponding end surface of the spring 25, becoming thereby stable in attitude. When the charge roller 8 is in contact with the photosensitive drum 7, the length Ld of the spring 25 is 6.4 mm (10.4 mm when uncompressed), and the amount of the pressure applied to the spacer 21 by the spring 25 to keep the charge roller 8 in contact with the photosensitive drum 7 is 7.7 N. Thus, the charge nip formed as the charge roller 8 is pressed upon the photosensitive drum 7 remains stable, and therefore, it is possible for the charge roller 8 to uniformly charge the peripheral surface of the photosensitive drum 7.

As described above, by equipping the process cartridge 1 with the spacer 21, the process cartridge 1 can be placed in the state in which the photosensitive drum 7 and charge roller 8 are kept separated from each other (FIG. 8(*a*)), or in the state in which the photosensitive drum 7 and charge roller 8 are kept in contact with each other (FIG. 8(*d*)). More concretely, as the process cartridge 1 receives driving force from the apparatus main assembly, the spacer 21 which is in the position in which it keeps the charge roller 8 separated from the photosensitive drum 7 (functions as member for keeping charge roller 8 from photosensitive drum 7) is rotationally moved about the axial line of the charge roller 8 by the driving force from the apparatus main assembly, into the position in which it allows the charge roller 8 to be kept in contact with the photosensitive drum 7 (functions as charge roller bearing).

When the spacer 21 functions as the bearing for the charge roller 8, the bottom section 21*e* of the spacer 21 is in contact with the one of the lengthwise ends of the spring 25. Further, as the charge roller 8 comes into contact with the photosensitive drum 7, the bottom section 21*e* of the spacer 21 becomes roughly level with the surface of the cartridge frame 17, which supports the spring 25. Further, even after the charge roller 8 comes into contact with the photosensitive drum 7 (FIG. 8(*d*)), the spacer 21 rotates until its bottom section 21*e* comes fully in contact with the corresponding end of the spring 25.

Thus, the spacer 21 is shaped so that as its bottom section 21*e* comes fully in contact with the spring 25, its gear section 21*b* disengages from the gear 22 attached to the shaft 24 of the brush roller 14, and does not come into contact with the gear 22 thereafter. Therefore, it does not occur that the charge roller 8 is made to vibrate by the contact between the gear section 21*b* of the spacer 21 and the gear 22 which might occur after the separation of the gear section 21*b* and gear 22. Therefore, the process cartridge 1 (image forming apparatus) is prevented from outputting unsatisfactory images, more specifically, images suffering from nonuniformity in density attributable to the problem that the peripheral surface of the photosensitive drum 7 fails to be uniformly charged by the charge roller 7, because of the vibration of the charge roller 8.

The spacer 21 is provided with the protrusively arced section 21*c*. Therefore, when the spacer 21 is rotationally moved from the position in which it functions as a very spacer, to the position in which it functions as a bearing (FIG. 9), it is possible for the spring 25 to smoothly slide from the protrusively arced section 21*c* onto the flat section 21*e*. Therefore, the pressure applied to the spacer 21 by the spring 25 always remains directed toward the axial line of the photosensitive drum 7. Incidentally, the changes which occur to the amount of the pressure applied to the spacer 21 by the spring 25 while the spacer 21 rotates about the rotational axis of the charge roller 8 are as shown in FIG. 9 (indicated by arrow marks).

(Attitude of Spring Related to Rotation of Spacer)

Figure 9:
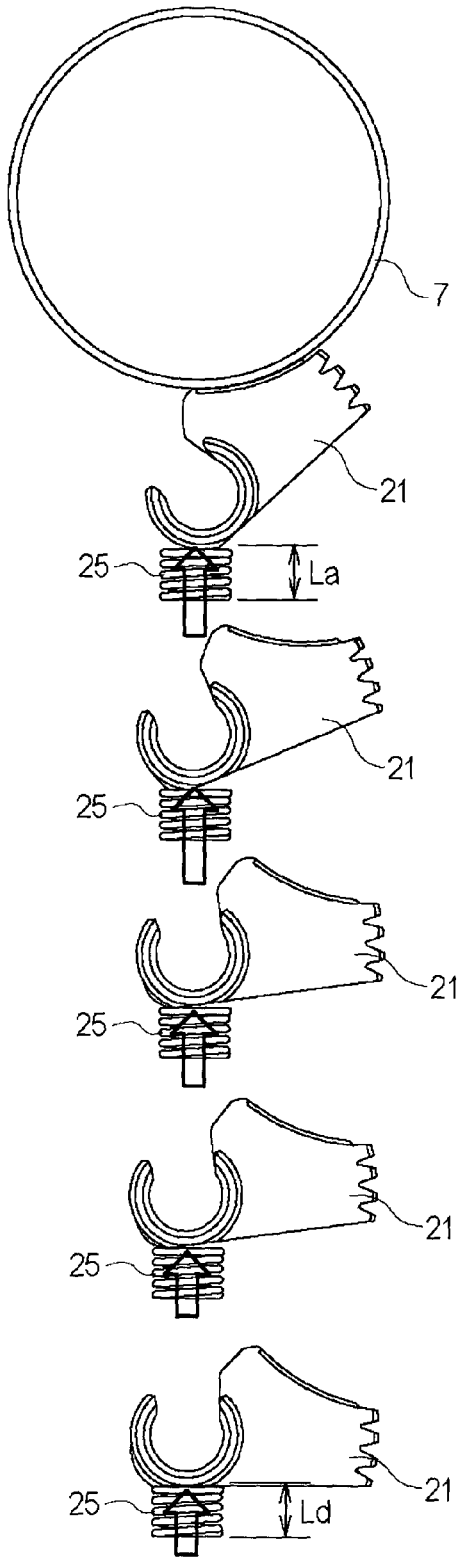
FIG. 9 is a drawing for describing the rotational movement of the spacer in the first embodiment.

Next, referring to FIG. 9, the attitude of the spring 25 during the rotational movement of the spacer 21 is described. While the charge roller 8 is kept separated from the photosensitive drum 7 by the spacer 21, the spring 25 is in contact with the protrusively arced section of the spacer 21. The spacer rotates about the rotational axis of the charge roller 8 by receiving driving force from the apparatus main assembly. During this rotation of the spacer 21, the spacer 21 pressures the spring 25 in the direction which is tangential to the protrusively arced section 21*c* of the spacer 21. Thus, the spring tends to become unstable in attitude.

In this embodiment, however, the mechanism for separating the charge roller 8 from the photosensitive drum 7 is structured as shown in FIG. 9. That is, it is structured so that when the charge roller 8 is kept separated from the photosensitive drum 7 by the spacer 21, the spring 25 is shorter than when the charge roller 8 is allowed by the spacer 21 to be kept in contact with the photosensitive drum 7. Also referring to FIG. 9, while the spacer 21 is rotationally moved from the position in which it keeps the charge roller 8 separated from the photosensitive drum 7, to the position in which it allows the charge roller 8 to be kept in contact with the photosensitive drum 7, the spring 25 remains in contact with the spacer 25 while allowing the spring 25 to extend. In comparison to a structural arrangement which the spacer 21 is rotationally moved while compressing the spring 25, the structural arrangement in this embodiment rotationally moves the spacer 21 while allowing the spring 25 to extend. Therefore, the structural arrangement in this embodiment is unlikely to make the spring 25 to tilt.

As described above, the spacer 21 with which the process cartridge 1 in this embodiment is provided to keep the charge roller 8 separated from the photosensitive drum 7 doubles as the bearing which keeps the charge roller 8 pressed upon the photosensitive drum 7. In other words, the member for keeping the charge roller 8 separated from the photosensitive drum 7 and the bearing for keeping the charge roller 8 in contact with the photosensitive drum 7 are integrated as the spacer 21. Therefore, by using the spacer 21 in this embodiment, not only is it possible to improve a process cartridge in the efficiency with which a process cartridge is assembled, but also, to stabilize the charge nip of the process cartridge without increasing the cartridge in length.

While the invention has been described with reference to the structures disclosed herein, it is not confined to the details set forth, and this application is intended to cover such modifications or changes as may come within the purposes of the improvements or the scope of the following claims.

INDUSTRIAL APPLICABILITY

According to the present invention, there is provided a process cartridge which keeps its charge roller and photosensitive member separated from each other until the cartridge receives the cartridge driving force from the main assembly of an image forming apparatus, is no greater in length than any process cartridge in accordance with the prior art, and is stable in the amount of force for keeping the charge roller in contact with the photosensitive member.

The invention claimed is:

1. A unit mountable to a main assembly of an image forming apparatus, said unit comprising:

a rotatable photosensitive member;

a charging roller for contacting and electrically charging said photosensitive member, said charging roller including a shaft;

a spacer for spacing said charging roller from said photosensitive member, said spacer including an integral bearing portion provided on said spacer for rotatably bearing said shaft;

a drive receiving portion provided on said spacer for receiving a driving force from the main assembly to rotate said spacer about an axis of said shaft so as to shift from a first position for spacing said charging roller from said photosensitive member to a second position for contacting said charging roller to said photosensitive member; and an urging portion for urging said spacer at a contact portion of said spacer that includes a first contact region contacted by said urging portion when said spacer is placed in the first position and a second contact region, which is different from the first contact region, contacted by said urging portion when said spacer is placed in the second position, wherein said contact portion has a shape such that a distance from the axis increases from said second contact region toward said first contact region.

2. The unit according to claim 1, wherein said second contact region is a flat surface.

3. The unit according to claim 1, further comprising:

an rotating member, disposed upstream of said charging roller with respect to a rotational moving direction of said photosensitive member, for rotating in contact with said photosensitive member, and a gear provided on said rotating member, wherein said drive receiving portion receives the driving force from said gear when said spacer is placed in the first position.

4. The unit according to claim 1, wherein an urging force of said urging portion applied to said spacer is smaller when said spacer is in the second position than when said spacer is in the first position.

5. The unit according to claim 1, wherein said first contact region is an arcuate surface and said second contact region is a flat surface.

* * * * *